US009163502B2

(12) United States Patent
Lehnert et al.

(10) Patent No.: US 9,163,502 B2
(45) Date of Patent: Oct. 20, 2015

(54) CHISEL HOLDER, AND CHISEL HOLDER SYSTEM COMPRISING A CHISEL HOLDER AND A BASE PART

(75) Inventors: Thomas Lehnert, Oberraden (DE); Karsten Buhr, Willroth (DE); Martin Lenz, Groβmaischeid (DE); Cyrus Barimani, Königswinter (DE); Günter Hähn, Königswinter (DE); Karl Kammerer, Fluorn-Winzeln (DE); Bernhard Diesner, Telfes im Stubai (AT); Markus Roth, Aichhalden (DE)

(73) Assignee: WIRTGEN GMBH, Windhagen (DE)

( * ) Notice: Subject to any disclaimer, the term of this patent is extended or adjusted under 35 U.S.C. 154(b) by 115 days.

(21) Appl. No.: 13/991,297

(22) PCT Filed: Dec. 2, 2011

(86) PCT No.: PCT/EP2011/071642

§ 371 (c)(1),
(2), (4) Date: Jun. 3, 2013

(87) PCT Pub. No.: WO2012/072802

PCT Pub. Date: Jun. 7, 2012

(65) Prior Publication Data

US 2013/0241265 A1 Sep. 19, 2013

(30) Foreign Application Priority Data

Dec. 3, 2010 (DE) ..... 10 2010 061 019
Jul. 4, 2011 (EP) ..... 11172527

(51) Int. Cl.
*E21C 35/19* (2006.01)
*E21C 35/193* (2006.01)
*E21C 35/18* (2006.01)

(52) U.S. Cl.
CPC ..... *E21C 35/18* (2013.01); *E21C 35/19* (2013.01); *E21C 35/1933* (2013.01); *E21C 2035/191* (2013.01)

(58) Field of Classification Search
CPC ... E21C 35/18; E21C 35/19; E21C 2035/191; E21C 35/193; E21C 35/1933; E21C 35/1936; E21C 35/197
See application file for complete search history.

(56) References Cited

U.S. PATENT DOCUMENTS 2,452,081 A 10/1948 Sullinger
3,498,677 A 3/1970 Morrow (Continued)

FOREIGN PATENT DOCUMENTS

CA 2742849 A1 5/2010
CN 1942655 A 4/2007

(Continued)

OTHER PUBLICATIONS

English translation of Notification for the Opinion of Examination with translation of the search report, Taiwanese Application No. 100144345, mailing date: Dec. 6, 2013, 5 pages.

(Continued)

*Primary Examiner* — David Bagnell
*Assistant Examiner* — Michael Goodwin
(74) *Attorney, Agent, or Firm* — Rothwell, Figg, Ernst & Manbeck, P.C.

(57) ABSTRACT

A chisel holder comprises a body zone (12) having a chisel receiving opening (18) that is open at least in the direction of a chisel insertion end (14) of the body zone (12), and also comprises a fastening shaft (26) which extends from a supporting end (20) of the body zone (12) and has a longitudinal shaft axis. A fastening member-affecting zone is provided on a first side of the fastening shaft (26), and a supporting zone (78) that has supporting surface regions (88, 90) which are inclined relative to each other and adjoin each other in a transition zone (92) extending in the direction of the longitudinal shaft axis is provided on a second side of the fastening shaft (26), said second side lying opposite the first side relative to the longitudinal shaft axis. Said chisel holder is characterized in that the transition zone (92) is designed like a cavity, or/and at least some sections of at least one supporting surface region (88, 90) project radially outward from a basic outer peripheral surface (94) of the fastening shaft (26) in relation to the longitudinal shaft axis.

19 Claims, 5 Drawing Sheets

(56) References Cited

U.S. PATENT DOCUMENTS

| | | | | |
|---|---|---|---|---|
| 3,992,061 | A | 11/1976 | Rollins | |
| 4,180,292 | A * | 12/1979 | Persson | 299/108 |
| 4,240,669 | A | 12/1980 | Rollins | |
| 4,275,929 | A | 6/1981 | Krekeler | |
| 4,302,055 | A | 11/1981 | Persson | |
| 4,415,208 | A | 11/1983 | Goyarts | |
| 4,542,943 | A | 9/1985 | Montgomery, Jr. | |
| 4,693,518 | A | 9/1987 | Sulosky et al. | |
| 4,828,327 | A | 5/1989 | Wechner | |
| 4,915,455 | A | 4/1990 | O'Neill et al. | |
| 5,186,575 | A | 2/1993 | Wirtgen | |
| 5,322,351 | A | 6/1994 | Lent | |
| 5,378,050 | A | 1/1995 | Kammerer et al. | |
| 5,529,384 | A | 6/1996 | Ojanen et al. | |
| 5,573,308 | A | 11/1996 | Simons et al. | |
| 5,683,144 | A | 11/1997 | Kammerer et al. | |
| 6,234,579 | B1 | 5/2001 | Montgomery, Jr. | |
| 6,244,665 | B1 | 6/2001 | Bise et al. | |
| 6,619,756 | B1 | 9/2003 | Holl et al. | |
| 6,619,757 | B1 | 9/2003 | Kammerer | |
| 6,644,755 | B1 | 11/2003 | Kammerer | |
| 6,685,273 | B1 | 2/2004 | Sollami | |
| 6,764,140 | B2 | 7/2004 | Carson, Jr. et al. | |
| 6,779,850 | B1 | 8/2004 | Schibeci et al. | |
| 6,866,343 | B2 | 3/2005 | Holl et al. | |
| 7,086,704 | B2 | 8/2006 | Holl et al. | |
| 7,300,115 | B2 | 11/2007 | Holl et al. | |
| D567,270 | S | 4/2008 | Chiang | |
| D574,689 | S | 8/2008 | Holl et al. | |
| D575,610 | S | 8/2008 | Holl et al. | |
| 7,461,903 | B2 | 12/2008 | Tewes et al. | |
| D585,259 | S | 1/2009 | Holl et al. | |
| 7,475,949 | B2 | 1/2009 | Helsel et al. | |
| 7,537,288 | B2 | 5/2009 | Chiang | |
| 7,547,075 | B2 | 6/2009 | Tewes et al. | |
| 7,597,402 | B2 | 10/2009 | Tewes et al. | |
| 7,784,875 | B2 | 8/2010 | Holl et al. | |
| 7,922,256 | B2 | 4/2011 | Kammerer et al. | |
| 7,922,257 | B2 | 4/2011 | Kammerer | |
| D638,453 | S | 5/2011 | Buhr et al. | |
| 8,061,783 | B2 | 11/2011 | Keller et al. | |
| D657,648 | S | 4/2012 | Wachsmann | |
| D666,226 | S | 8/2012 | Buhr et al. | |
| D666,641 | S | 9/2012 | Buhr et al. | |
| D666,642 | S | 9/2012 | Buhr et al. | |
| D666,643 | S | 9/2012 | Buhr et al. | |
| D671,578 | S | 11/2012 | Buhr et al. | |
| 8,622,484 | B2 | 1/2014 | Charlton | |
| 2002/0074850 | A1 | 6/2002 | Montgomery, Jr. | |
| 2002/0109395 | A1 | 8/2002 | Sollami | |
| 2004/0051370 | A1 | 3/2004 | Montgomery, Jr. | |
| 2006/0119165 | A1 | 6/2006 | Holl et al. | |
| 2007/0257545 | A1 | 11/2007 | Mouthaan et al. | |
| 2008/0093912 | A1 | 4/2008 | Willoughby | |
| 2009/0085396 | A1 | 4/2009 | Chiang | |
| 2009/0293249 | A1 | 12/2009 | Lehnert et al. | |
| 2010/0045094 | A1 | 2/2010 | Sollami | |
| 2010/0076697 | A1 * | 3/2010 | Wagner et al. | 702/34 |
| 2011/0006588 | A1 | 1/2011 | Monyak et al. | |
| 2011/0148178 | A1 | 6/2011 | Lehnert et al. | |
| 2011/0148179 | A1 | 6/2011 | Lehnert et al. | |
| 2011/0266860 | A1 | 11/2011 | Charlton | |

FOREIGN PATENT DOCUMENTS

| | | | |
|---|---|---|---|
| CN | 101018927 | A | 8/2007 |
| CN | 101091037 | A | 12/2007 |
| CN | 101175895 | A | 5/2008 |
| CN | 202595605 | U | 12/2012 |
| CN | 202788849 | U | 3/2013 |
| DE | 2940288 | A1 | 5/1980 |
| DE | 3411602 | A1 | 10/1985 |
| DE | 4322401 | A1 | 1/1995 |
| DE | 19908656 | | 8/2000 |
| DE | 10161009 | | 11/2002 |
| DE | 202005001311 | | 3/2005 |
| DE | 102004057302 | A1 | 6/2006 |
| DE | 102005010678 | | 9/2006 |
| DE | 102005017760 | | 10/2006 |
| DE | 102005017760 | A1 | 10/2006 |
| DE | 102005055544 | | 5/2007 |
| DE | 202007013350 | U1 | 3/2008 |
| DE | 102004030691 | B4 | 12/2008 |
| DE | 10261646 | | 2/2010 |
| DE | 202009014077 | | 4/2010 |
| DE | 102009059189 | | 6/2011 |
| DE | 102009059189 | A1 | 6/2011 |
| EM | 001848938 | | 4/2011 |
| EP | 0706606 | B1 | 3/1997 |
| EP | 0771911 | A1 | 5/1997 |
| EP | 997610 | | 5/2000 |
| JP | 4527043 | | 10/1970 |
| JP | 2008503669 | A | 2/2008 |
| JP | 2008530393 | A | 8/2008 |
| JP | 2008540875 | A | 11/2008 |
| JP | 2009536701 | A | 10/2009 |
| JP | 2010203197 | A | 9/2010 |
| KR | 1020050091022 | A | 9/2005 |
| TW | 407538 | U | 10/2000 |
| TW | I285836 | B | 11/2006 |
| TW | M326448 | U | 2/2008 |
| TW | M364551 | U1 | 9/2009 |
| TW | M378059 | U | 4/2010 |
| WO | 2006056269 | A1 | 6/2006 |
| WO | 2006119536 | A1 | 11/2006 |
| WO | 2010051593 | | 5/2010 |
| WO | 2011004030 | | 1/2011 |

OTHER PUBLICATIONS

First Examination Report with English translation, Chinese Patent Application No. 201110395057.2, Applicant: Wirtgen GmbH, Mailing Date: Jan. 30, 2014, 11 pages.

DE102010061019.4 , "Examination Report", Oct. 20, 2011, 4 pages.

EP11172525.5 , "European Search Report", Dec. 8, 2011, 5 pages.

EP11172527.1 , "European Search Report", Dec. 8, 2011, 5 pages.

Written Opinion issued for Singapore parallel patent application 2013041637 mailed on Jun. 27, 2014, 13 pages.

English translation of first official communication and search report from Taiwanese Patent Office mailed May 9, 2014, for related Taiwanese application No. 100144342, 9 pages.

U.S. Appl. No. 13/822,895, filed Mar. 13, 2013 to Lehnert et al. (not prior art).

U.S. Appl. No. 13/822,917, filed Mar. 13, 2013 to Lehnert et al. (not prior art).

U.S. Appl. No. 13/989,837, filed Dec. 2, 2011 to Kammerer et al. (not prior art).

U.S. Appl. No. 29/452,133, filed Apr. 12, 2013 to Buhr et al, (not prior art).

U.S. Appl. No. 29/452,136, filed Apr. 12, 2013 to Buhr et al. (not prior art).

U.S. Appl. No. 29/452,137, filed Apr. 12, 2013 to Buhr et al. (not prior art).

U.S. Appl. No. 29/452,139, filed Apr. 12, 2013 to Buhr et al. (not prior art).

Written Opinion and Search Report issued for Singapore application No. 2013042320, dated Jun. 5, 2014, 19 pages.

First Office Action dated Jan. 28, 2014, in related Chinese patent application No. 201110394832.7, with English translation, 19 pages.

English translation of Notification for the Opinion of Examination issued for Taiwanese Application No. 100144345, mailed on Aug. 18, 2014, 3 pages.

Office Action issued for Japanese patent application No. 2013-541376 dated Jul. 9, 2015 (7 pages).

* cited by examiner

CHISEL HOLDER, AND CHISEL HOLDER SYSTEM COMPRISING A CHISEL HOLDER AND A BASE PART

PRIOR RELATED APPLICATIONS

This application is a National Phase application of International Application No. PCT/EP2011/071642 filed Dec. 2, 2011, which claims priority to German Patent Application No. 10 2010 061 019.4 filed Dec. 3, 2010 and European Patent Application 11172527.1 filed Jul. 4, 2011, each of which is incorporated herein by reference in its entirety.

The present invention relates to a chisel holder, comprising a body region having a chisel-receiving opening which is open at least toward a chisel insertion side of the body region and a fastening shank which extends from a supporting side of the body region and which has a shank longitudinal axis, wherein on the fastening shank there are provided, on a first side, a fastening element loading region and, on a second side situated opposite in relation to the shank longitudinal axis, a supporting region with supporting surface regions which are inclined relative to one another and adjoin one another in a first transition region extending in the direction of the shank longitudinal axis.

A chisel holder of said type is known from DE 10 2004 057 302 A1. The fastening shank of said known chisel holder is formed with a flattened cross-sectional profile. On a first side, which is formed as a narrow side, there is formed a depression which, with a surface inclined relative to the shank longitudinal axis, provides a fastening element loading surface of the fastening element loading region. On the opposite, second side, that is to say here likewise a narrow side, there are provided two substantially planar supporting surface regions which are elongate in the direction of the shank longitudinal axis and which converge on one another in a wedge-like manner and which adjoin one another in a likewise substantially planar, that is to say non-curved transition surface. Said two supporting surface regions provide respective centering surfaces which are pressed against complementary counterpart centering surfaces or counterpart supporting surface regions of a chisel holder by the load exerted on the fastening element loading surface by means of a fastening element.

It is the object of the present invention to provide a chisel holder and a chisel holder system having a chisel holder and a base part, by means of which the loads occurring in the fastening shank can be reduced or transmitted optimally to a base part.

According to the invention, said object is achieved by means of a chisel holder, comprising a body region having a chisel-receiving opening which is open at least toward a chisel insertion side of the body region and a fastening shank which extends from a supporting side of the body region and which has a shank longitudinal axis, wherein on the fastening shank there are provided, on a first side, a fastening element loading region and, on a second side situated opposite in relation to the shank longitudinal axis, a supporting region with supporting surface regions which are inclined relative to one another and adjoin one another in a transition region extending in the direction of the shank longitudinal axis.

It is also provided here that the transition region is formed in the manner of a depression, and/or that at least one supporting surface region is formed so as to protrude at least in regions radially outward in relation to the shank longitudinal axis beyond a main outer circumferential surface of the fastening shank.

In a departure from the substantially planar embodiment of the first transition region between the two supporting surface regions, such as is known from the prior art, it is the case according to a first aspect of the chisel holder according to the invention that a depression-like, that is to say inwardly recessed transition region is provided. It has been found that this leads to an improved distribution of the loading or stresses in the fastening shank when a load is exerted on the fastening element loading region from the other side by a fastening element and when, during milling operation, from the body region adjoining the fastening shank, there is likewise introduced a load which is introduced into the fastening shank and transmitted via the supporting surface regions thereof to a base part.

According to the aspect of the chisel holder according to the invention which is alternatively or else additionally to be provided, at least one supporting surface region protrudes outward at least in regions such that, here, a configuration of said supporting surface region can be realized which is substantially independent of the geometric configuration of the fastening shank itself. In this way, too, it is possible to realize an optimized adaptation to the occurring loads, while at the same time it is made considerably easier to machine the chisel holder in said region in order to provide the required precision of the supporting surface region.

The transition region may for example be provided at least in regions by a concave depression, that is to say a depression which is of curved form and which is thus likewise optimized with regard to the stress conditions.

In a particularly advantageous design variant, it may be provided that at least one supporting surface region, in the direction from its circumferential end region remote from the transition region toward its circumferential end region proximate to the transition region, approaches the radial level of the main outer circumferential surface. By means of said design, an excessively intense wedging action of the supporting surface regions which are basically inclined relative to one another is avoided.

The transition of at least one supporting surface region at its circumferential end region remote from the transition region into the main outer circumferential surface of the fastening shank may be of stepped and/or curved form.

Focusing of the fastening load onto a region provided in a defined manner for this purpose may be attained, while maintaining simplified machinability of the chisel holder, by virtue of at least one supporting surface region, in its axial end region proximate to the body region and/or in its axial end region remote from the body region, merging in a stepped and/or curved manner into the main outer circumferential surface.

A uniform loading of the chisel holder and of the fastening shank both in the case of loading by a fastening element and also in the case of an introduction of forces occurring during milling operation may be assisted by virtue of the supporting surface regions and/or the transition region being formed so as to be substantially symmetrical in relation to a holder central plane. It is pointed out here that the holder central plane may be a plane situated substantially in the geometric center of the holder, spanned for example by the shank longitudinal axis and a longitudinal central axis of the chisel-receiving opening.

A uniform force distribution may be assisted by virtue of at least one supporting surface region being formed so as to be curved around the shank longitudinal axis. Here, a uniform, that is to say substantially circular curvature may be provided, wherein for manufacturing reasons the two supporting surface regions have the same radius of curvature and/or curvature central point. Alternatively, it is self-evidently also possible to provide a curvature with a varying radius of curvature, for example a radius of curvature which increases or decreases in a direction away from the first transition region.

To assist a simple production process for the chisel holder, it is also proposed that the fastening shank is formed, in the region of its main outer circumferential surface, with a round, preferably circular, oval or elliptical outer circumferential contour.

To keep the forces which act on the fastening shank transversely with respect to the shank longitudinal axis thereof, and which subject said fastening shank to shear and torsion loading in the region adjoining the body region, as low as possible, it is proposed that a longitudinal central axis of the chisel-receiving opening and the shank longitudinal axis are inclined relative to one another at an angle of 6° to 24°, preferably approximately 12°. Said angle has proven to be particularly advantageous because it has been found that, during milling operation, the forces acting on a chisel are generally not oriented parallel to the longitudinal axis thereof and are consequently also not oriented in the direction of the longitudinal axis of the chisel-receiving opening, but rather are inclined slightly relative thereto. Said inclination can be allowed for by the angled configuration of the shank longitudinal axis relative to the longitudinal axis of the chisel-receiving opening.

According to a further advantageous aspect, it is possible for the fastening shank to comprise a fastening element loading region a fastening element loading surface, and for the shank longitudinal axis and a surface normal of the fastening element loading surface to be inclined relative to one another at an angle of 50° to 65°, preferably approximately 62.5°. As a result of said relatively shallow angled configuration of the surface normal of the fastening element loading surface relative to the shank longitudinal axis, it is achieved that a force exerted approximately also in the direction of said surface normal on the fastening element loading surface via a fastening element is inclined as little as possible relative to the shank longitudinal axis, that is to say exerts a load on said shank to the greatest possible extent in the direction of the longitudinal axis thereof. It is also possible for transverse loads in the shank to be reduced, but nevertheless for such an orientation of a fastening element formed for example as a stud bolt to be ensured, by virtue of engagement with the fastening element being generated when the chisel holder is inserted into a base part.

According to a further aspect, the object mentioned in the introduction is achieved by means of a chisel holder system with a chisel holder constructed preferably according to the invention and with a base part having a fastening shank receiving opening, which is open at least toward a counterpart supporting side, and a fastening element receiving opening, which is open toward the fastening shank receiving opening, wherein a fastening element which can be moved in order to exert load on the fastening element loading region is received in the fastening element receiving opening, wherein, in the fastening shank receiving opening, there is provided a counterpart supporting region with counterpart supporting surface regions which adjoin one another in a further transition region which extends in the direction of a fastening shank receiving opening longitudinal axis.

An optimization of the force transmission interaction with the chisel holder may be attained here by virtue of the further transition region being formed in the manner of a projection, for example by a convex projection, such that a design substantially complementary to the transition region can be attained if said transition region is formed with a depression-like, for example concave contour.

To be able, in the region of the fastening shank receiving opening, too, to attain a surface design complementary to the geometry of the fastening shank, it is proposed that at least one counterpart supporting surface region is formed so as to protrude at least in regions radially inward in relation to the fastening shank receiving opening longitudinal axis beyond a main inner circumferential surface of the fastening shank receiving opening. As is the case with the chisel holder itself, it is thus the case for the base part, too, that only limited surface regions, specifically the counterpart supporting surface regions, need be machined precisely in order to be able to ensure a very exact, areal fit between the supporting surface region and the counterpart supporting surface region.

Here, too, it may be provided that at least one counterpart supporting surface region protrudes, at least in its circumferential end region proximate to the second transition region, beyond the main inner circumferential surface, and, in the direction of its circumferential end region remote from the further transition region, approaches the radial level of the main inner circumferential surface, and/or that at least one counterpart supporting surface region, at least in its axial end region proximate to the counterpart supporting side and/or in its axial end region remote from the counterpart supporting side, merges in a stepped and/or curved manner into the main inner circumferential surface.

Correspondingly to the shaping of the fastening shank, it may also be provided in the base part that the fastening shank receiving opening is formed with a circular inner circumferential contour in the region of its main inner circumferential surface and/or in the region of its counterpart supporting surface regions. Owing to the provision of a basically circular inner circumferential contour, the fastening shank receiving opening can be formed into the base part, which is generally produced as a forged part, in a relatively simple manner by means of a drilling or milling process. The provision of planar, that is to say non-curved surface regions in the interior of the fastening element receiving opening is not necessary.

A more comprehensive reduction of the forces acting in the fastening shank transversely with respect to the shank longitudinal axis thereof may be attained by virtue of the fastening shank receiving opening longitudinal axis and a fastening element receiving opening longitudinal axis being inclined relative to one another at an angle of 50° to 65°, preferably approximately 62.5°.

The present invention will be described in detail below with reference to the appended figures, in which:

FIG. 9 shows a perspective view of a chisel holder;

Figure 1:
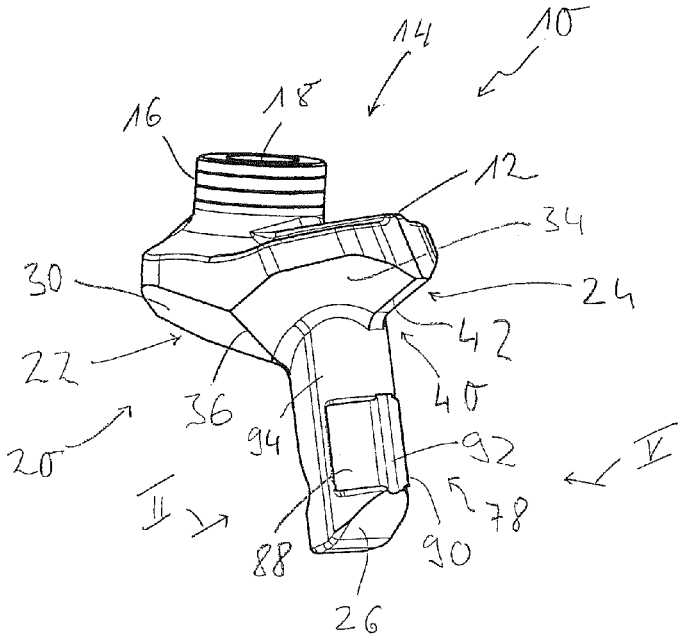
FIG. 1 shows a perspective view of a chisel holder in a viewing direction I in FIG. 2.
Figure 2:
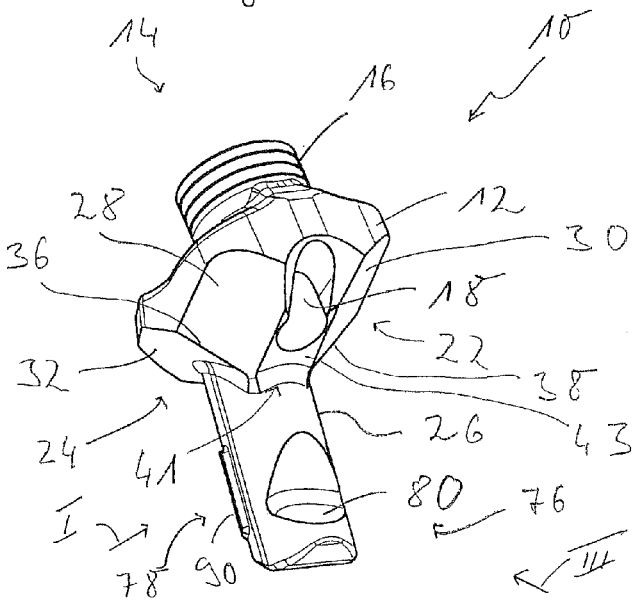
FIG. 2 shows a perspective view of the chisel holder of FIG. 1 in a viewing direction II in FIG. 1.
Figure 4:
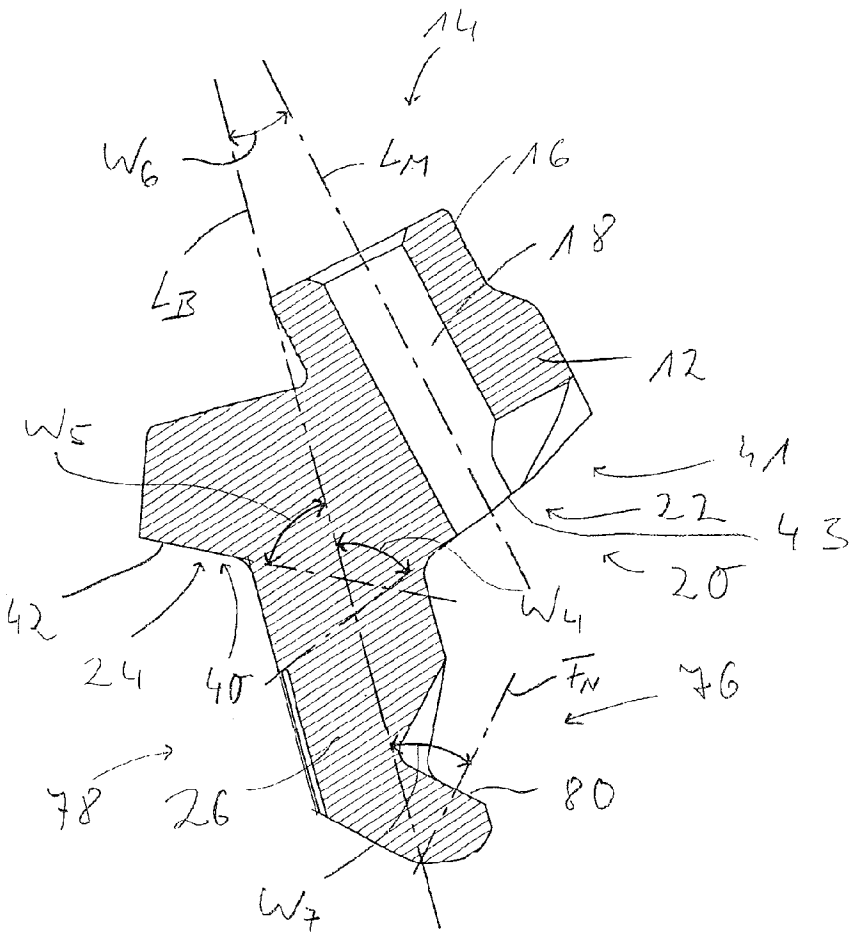
FIG. 4 shows a sectional view of the chisel holder sectioned in a holder central plane.
Figure 3:
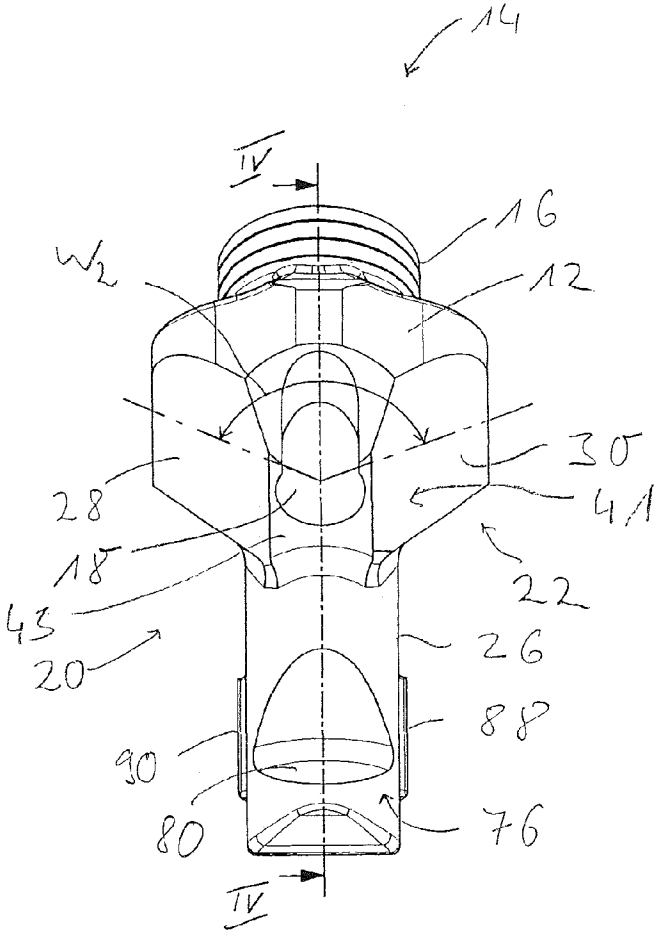
FIG. 3 shows a view of the chisel holder in a viewing direction III in FIG. 2.
Figures 5, 6, 7, 8:
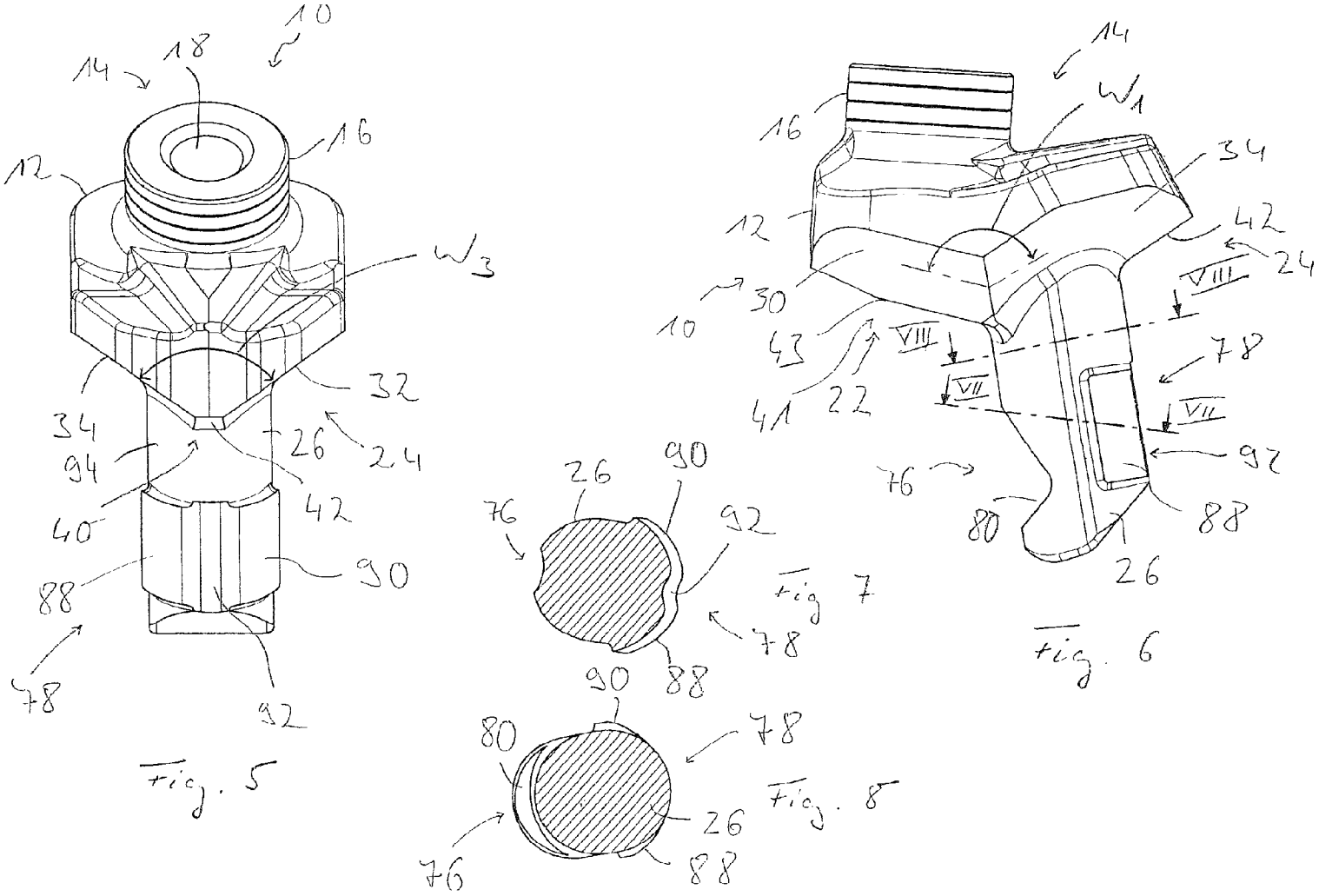
FIG. 5 shows a view of the chisel holder in a viewing direction V in FIG. 1.
FIG. 6 shows a side view of the chisel holder.
FIG. 7 shows a sectional view of the chisel holder in the region of a fastening shank, sectioned along a line VII-VII in FIG. 6.
FIG. 8 shows a sectional view of the chisel holder in the region of a fastening shank, sectioned along a line VIII-VIII in FIG. 6.

FIGS. 1 to 6 show a chisel holder, denoted generally by 10, for a milling roller of a road milling machine. The chisel holder 10 comprises a body region 12 with an approximately cylindrical projection 16 which extends therefrom at a chisel insertion side denoted generally by 14. A chisel-receiving opening 18 is provided in the cylindrical projection 16 so as to extend through the latter and through the entire body region 12. Said chisel-receiving opening is open at the chisel insertion side 14 in order to receive an exchangeable chisel which can be locked therein with a frictional force fit, and said chisel-receiving opening is open at a supporting side 20, which is situated substantially opposite the chisel insertion side 14, of the body region 12. From said supporting side, a tool used for the removal of a worn chisel from the chisel-receiving opening 18 can be inserted in order to thereby push the chisel out of the chisel opening 18.

On the body region 12, there are provided on the supporting side 20 a first supporting surface region 22 and a second supporting surface region 24 which is angled relative to said first supporting surface region. It can be seen in the illustrations that the chisel-receiving opening 18 is open toward the supporting side 20 in the region of the first supporting surface region 22. An elongate fastening shank 26 extends from the body region 12 proceeding substantially from the second supporting surface region 24. The fastening shank 26 is formed with a generally round, for example circular or oval or elliptical, outer circumferential contour. The structural design of the fastening shank 26 will be discussed in more detail below.

The first supporting surface region 22 comprises a first supporting surface 28 and a second supporting surface 30. Said two supporting surfaces 28, 30 of the first supporting surface region 22 are angled relative to one another and are formed so as to be substantially symmetrical, or also inclined at the same angle, relative to a holder central plane which corresponds substantially to the plane of the drawing of FIG. 4. It is pointed out here that the holder central plane may for example be spanned by a longitudinal axis $L_M$ of the chisel-receiving opening 18 and a shank longitudinal axis $L_B$ of the fastening shank 26.

The second supporting surface region 24 also comprises a first supporting surface 32 and a second supporting surface 34. The two supporting surfaces 32, 34 are angled relative to one another and thus also relative to the holder central plane, wherein here, the configuration relative to the holder central plane may be symmetrical, corresponding to the configuration of the two supporting surfaces 28, 30 of the first supporting surface region 22.

First transition regions 36, 38 which are linear and preferably extend in straight fashion are formed between the first supporting surface 28 of the first supporting surface region 22 and the first supporting surface 32 of the second supporting surface region 24 and likewise between the second supporting surface 30 of the first supporting surface region and the second supporting surface 34 of the second supporting surface region 24, which first transition regions likewise also define a transition between the first supporting surface region 22 and the second supporting surface region 24. It can be clearly seen in particular in FIGS. 1 and 2 that said first transition regions 36, 38 are formed at a region of adjoinment, which is of edge-like form, of the respective supporting surfaces. Owing to the fact that the supporting surfaces 28, 30, 32, 34 are preferably all of planar, that is to say non-curved form, said first transition regions 36, 38 which are thus also of linear form are correspondingly also not curved.

A second transition region 40 formed between the first supporting surface 32 and the second supporting surface 34 of the second supporting surface region 24 is formed with a transition surface 42 which extends in substantially straight fashion. Said transition surface is substantially orthogonal with respect to the holder central plane. Since the two supporting surfaces 32, 34 are substantially planar, that is to say not curved, said second transition region 40 also extends substantially rectilinearly.

Where the two supporting surface regions 22, 24 or the supporting surfaces 28, 30 and 32, 34 thereof adjoin one another, that is to say at the first transition regions 36, 38, an angle $W_1$ is formed which lies in the region of approximately 137°. An angle $W_2$ of approximately 130° is formed between the two supporting surfaces 28, 30 of the first supporting surface region 22, such that each of said supporting surfaces 28, 30 has an angle of inclination of approximately 65° with respect to the holder central plane. An angle $W_3$ of approximately 110° is formed between the two supporting surfaces 32, 34 of the second supporting surface region 24, such that each of said supporting surfaces 32, 34 has an angle of inclination of approximately 55° with respect to the holder central plane. This means generally that the two supporting surfaces 28, 30 of the first supporting surface region 22 are arranged so as to enclose between them a larger angle than that enclosed between the two supporting surfaces 32, 34 of the second supporting surface region 24. Furthermore, the shank longitudinal axis $L_B$ is oriented relative to the body region 12 such that the fastening shank is inclined relative to the first supporting surface region 22 and relative to the second supporting surface region 24 at an angle $W_4$ and $W_5$ respectively, said angle being in each case approximately 65°. The angle $W_4$ may for example lie in the region of 67°, while the angle $W_5$ may be approximately 64°. It is pointed out here that, for the determination of said angles $W_4$ and $W_5$, consideration may be given to a line which connects the respective supporting surfaces 28, 30 and 32, 34 in an imaginary elongation thereof, or in the case of the supporting surfaces 32, 34, the angle $W_5$ may also be determined relative to the transition surface 42 of the second transition region 40, and in the case of the supporting surfaces 28, 30, the angle $W_4$ may also be determined relative to a transition surface 43 of a further transition region 41 on the chisel holder 10. The total angle formed by the sum of the two angles $W_4$ and $W_5$ may thus lie in a region of approximately 131° and defines the angle of inclination of two prismatic configurations, one of which is defined by the two supporting surfaces 28, 30 of the first supporting region 22 and the other of which is defined by the two supporting surfaces 32, 34 of the second supporting surface region 24. By varying said total angle, that is to say the sum of the two angles $W_4$ and $W_5$, it is thus possible, for example while maintaining the same angles $W_2$ and $W_3$, to manipulate the geometry of the pyramid-like arrangement formed by the four supporting surfaces 28, 30, 32, 34, and in particular for a concentration of the forces in the direction of an imaginary pyramid peak to be assisted.

Owing to said angled orientation of the various supporting surface regions 22, 24 or of the supporting surfaces 28, 30, 32, 34 thereof, and owing to the orientation of the fastening shank 26 relative to the body region 12, a concentration of the forces introduced into the body region 12 during milling operation is attained in such a way that transverse forces which subject the transition between the body region 12 and the fastening shank 26 to shear loading are significantly reduced. This is also contributed to by the fact that an angle $W_6$ formed between the shank longitudinal axis $L_B$ and the longitudinal axis $L_M$ of the chisel-receiving opening 18 and consequently of a chisel longitudinal axis lies in a region of 12.5°.

Figure 10:
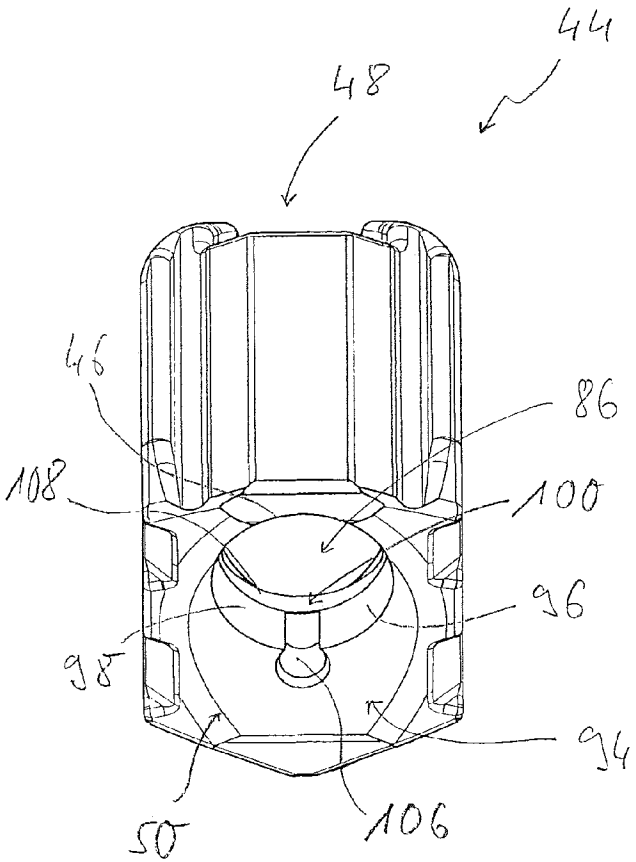
FIG. 10 shows a view of the chisel holder in FIG. 9 in a viewing direction X in FIG. 9.
Figure 5:
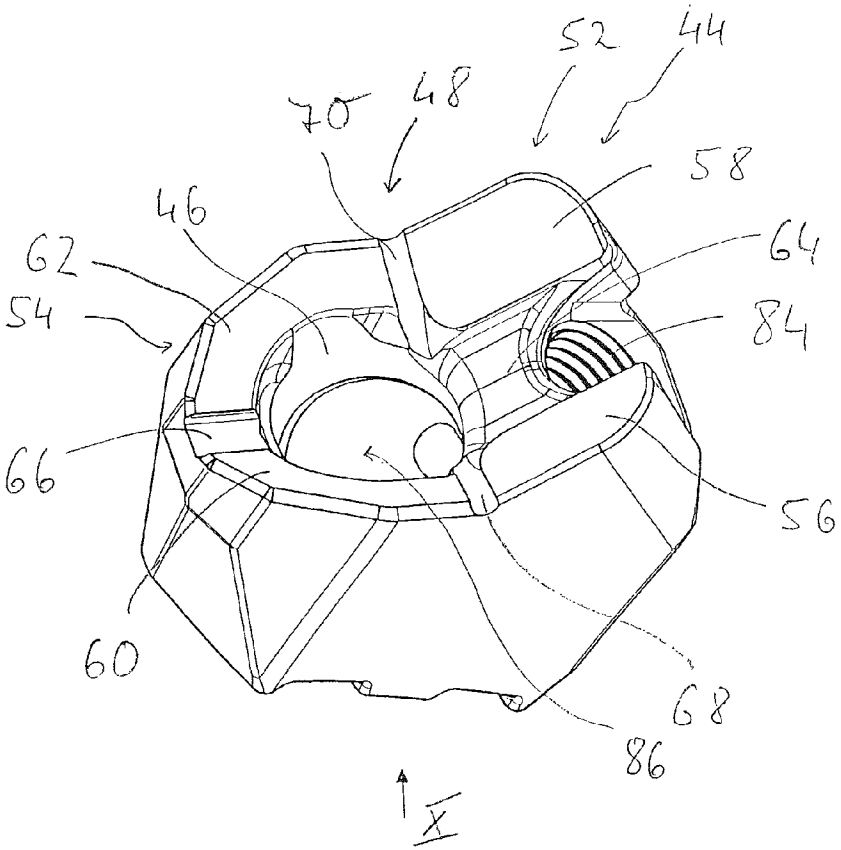
Figure 12:
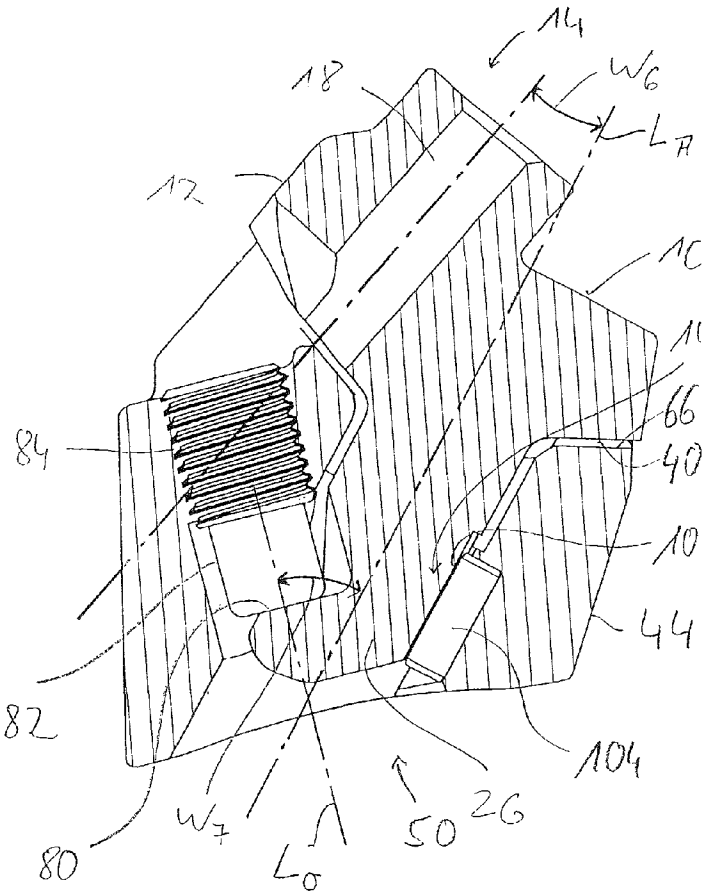
FIG. 12 shows a sectional illustration of the assembly of FIG. 11, sectioned in the holder central plane.
Figure 11:
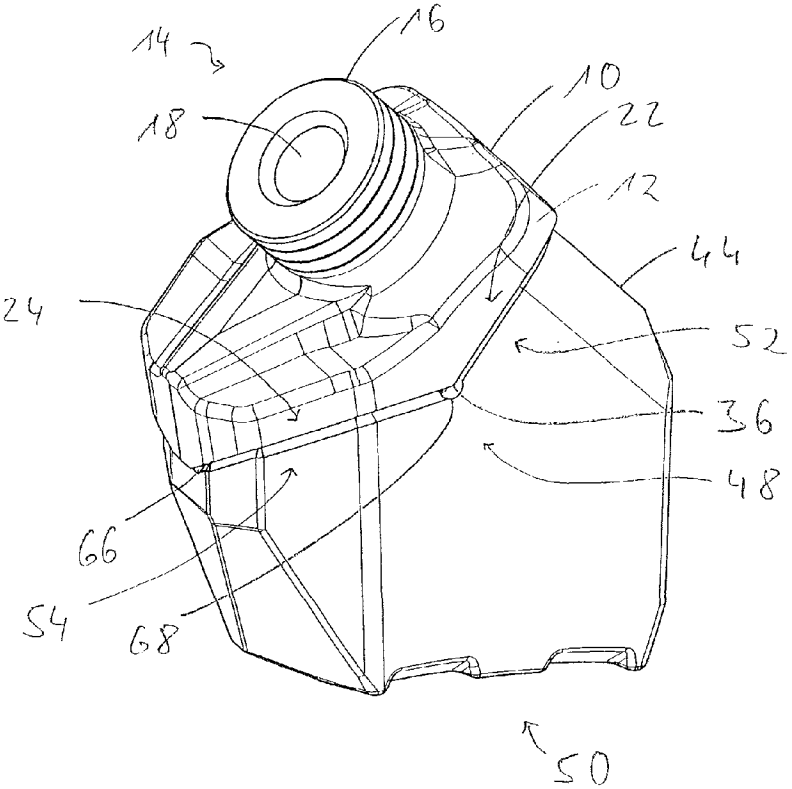
FIG. 11 shows a perspective illustration of the chisel and of the chisel holder in the assembled state.

FIGS. 9 and 10 illustrate a base part 44 that can be used in conjunction with the above-described chisel holder 10. FIGS. 11 and 12 show said base part 44 in an assembled state with the chisel holder 10.

In the base part 44 there is formed a fastening shank receiving opening 46 which is open both at a counterpart supporting side 48, visible at the top in FIG. 9, and also a connecting side 50, visible in FIG. 10, of the base part 44. In the region of the connecting side 50, the base part 44 is fixed to a milling roller for example by welding.

On the counterpart supporting side 48, a first counterpart supporting surface region 52 is formed so as to be assigned to the first supporting surface region 22. A second counterpart supporting surface region 54 is formed so as to be assigned to the second supporting surface region 24. The first counterpart supporting surface region 52 comprises a first counterpart supporting surface 56 assigned to the first supporting surface 28 of the first supporting surface region 22, and comprises a second counterpart supporting surface 58 assigned to the second supporting surface 30 of the first supporting surface region 22. Correspondingly, the second counterpart supporting surface region 54 comprises a first counterpart supporting surface 60 assigned to the first supporting surface 32 of the second supporting surface region 24, and comprises a second counterpart supporting surface 62 assigned to the second supporting surface 34 of the second supporting surface region 24. The respective counterpart supporting surfaces 56, 58, 60, 62 are angled relative to one another corresponding to the respective angles of the supporting surfaces 28, 30, 32, 34 of the chisel holder 10 relative to the one another and are of planar form, such that the supporting surfaces and counterpart supporting surfaces which are assigned to one another can bear areally against one another.

In each case one depression-like third transition region 64 and 66 is formed firstly between the first counterpart supporting surface 56 and the second counterpart supporting surface 58 and secondly between the first counterpart supporting surface 60 and the second counterpart supporting surface 62. A depression-like fourth transition region 68, 70 is likewise formed between the two counterpart supporting surface regions 52, 54, that is to say between the first counterpart supporting surface 56 and the first counterpart supporting surface 60 and between the second counterpart supporting surface 58 and the second counterpart supporting surface 62. Said depression-like transition regions 64, 66, 68, 70, which are formed for example with an at least partially rounded contour, firstly prevent the occurrence of notch stresses during the introduction of milling forces. Secondly, as is clearly shown by the illustrations of FIGS. 11 and 12, space is created in each case at the depression-like transition regions 64, 66, 68, 76 for the various transition regions of the chisel holder 10, where the supporting surfaces thereof merge into one another. This ensures that, even if wear occurs in the region of the mutually adjoining supporting surfaces and counterpart supporting surfaces, it is made possible for the first and second transition regions to reposition, and accordingly penetrate more deeply, into the third and fourth transition regions.

It can be clearly seen from FIGS. 9, 11 and 12 that firstly the supporting side 20 formed on the chisel holder 10 and secondly the counterpart supporting side 48 formed on the base part 44 are in particular of complementary form with the supporting surfaces and counterpart supporting surfaces which come into contact with one another. The plurality of supporting surfaces and counterpart supporting surfaces which adjoin one another in prismatic fashion thus form a funnel-like configuration which ensures stable support of the chisel holder 10 and base part 44 even in the direction transversely with respect to the fastening shank 26 or the shank longitudinal axis $L_B$. This leads generally to the fastening shank 26 being relieved of load in particular in the transverse direction, whereby the risk of breakage of the fastening shank is considerably reduced.

In addition to the supporting interaction between the chisel holder 10 and the base part 44 in the region of the supporting side 20 and of the counterpart supporting side 48, as explained in detail above, it is the case in the chisel holder system constructed according to the invention that the fastening shank 26 is further relieved of load as a result of its abutting interaction with the base part 44 in the region of the fastening shank receiving opening 46 thereof. This aspect and the supporting aspect already explained in detail above can in each case, even on their own, achieve a considerable relief of load or more uniform force distribution. It is however particularly advantageous for these to be realized in combination in one and the same chisel holder system.

The fastening shank 26 of the chisel holder 10 has a fastening element loading region 76 on a first side situated approximately below the first supporting surface region 22, and has a supporting region 78 on a second side situated opposite in relation to the shank longitudinal axis $L_B$. The fastening element loading region is formed in the manner of a notch with a fastening element loading surface 80, the surface normal $F_N$ of which is inclined relative to the shank longitudinal axis $L_B$ at a relatively shallow angle $W_7$ of approximately 62.5°. This has the effect that a fastening element 82, which is provided on the base part and whose longitudinal central axis is oriented approximately parallel to the surface normal $F_N$, that is to say substantially orthogonal with respect to the fastening element loading surface 80, generates a relatively high force component oriented in the direction of the shank longitudinal axis $L_B$ when the fastening shank 26 is subjected to load. It is pointed out here that the fastening element 82 is received in a fastening element receiving opening 84 of the base part 44, which fastening element receiving opening is formed at least in regions with an internal thread, such that the fastening element 82, which is correspondingly formed at least in regions with an external thread, can be moved in the direction of or away from the fastening element loading surface 80 by means of a turning, that is to say screw movement in the direction of a fastening element receiving opening longitudinal axis $L_O$.

Owing to the geometric relationships discussed above, the fastening element receiving opening longitudinal axis $L_O$ is at the angle $W_7$ of approximately 62.5° relative to a fastening shank receiving opening longitudinal axis $L_A$ which, in the assembled state, also substantially corresponds at least with regard to its orientation to the shank longitudinal axis $L_B$.

If the fastening element 82 is moved into the fastening element receiving opening 84 by means of a screw movement and pressed against the fastening element loading surface 80, the fastening shank 26 is pressed with its supporting region 78 against a counterpart supporting region 86 of the base part 44. The supporting region 78 is formed with two supporting surface regions 88, 90 which run at an angle or inclined relative to one another, and in particular have in each case a preferably circularly curved profile in the circumferential direction around the shank longitudinal axis $L_B$. In a central region of the supporting region 78, said two supporting surface regions 88, 90 adjoin one another in a fifth transition region 92. Said fifth transition region 92 is formed in the manner of a depression, preferably with a concave depression profile extending in the direction of the shank longitudinal axis $L_B$.

It can be clearly seen that the supporting surface regions 88, 90 of the supporting region 78 are formed such that they protrude radially in relation to the fastening shank longitudinal axis $L_B$ at least in regions beyond a main outer circumferential surface 94 of the fastening shank 26. The design is such that said radial projecting length is at its smallest in the central region of the supporting region 78, that is to say where the fifth transition region 92 is formed, such that there, there is for example virtually no radial projection, whereas said radial projecting length increases in the circumferential direction and in the direction away from the fifth transition region 92. It can be seen in particular that in each case one step-like, if appropriate also slightly curved transition to the main outer circumferential surface 94 of the fastening shank 26 is provided both at the axial end regions of the supporting surface regions 88, 90 and also at the end regions remote from the fifth transition region 92 in the circumferential direction.

As a result of the fastening shank 26 being designed in the manner described above, said fastening shank, when subjected to load by the loading element 82, is supported in two surface regions situated laterally with respect to the holder central plane, specifically substantially by means of the supporting surface regions 88, 90, on the base part 44. This leads to a pressure distribution and to the avoidance of linear supporting contact at the circumferential center of the supporting region 78. In particular, owing to the depression-like fifth transition region 92, it is ensured that, at said center of the supporting region 78, no forces or only small forces are transmitted between the fastening shank 26 and the base part 44.

A further significant advantage of the supporting surface regions 88, 90 which protrude radially beyond the main outer circumferential surface 94 is that, there, locally delimited surface regions are utilized in order to generate abutting contact between the fastening shank 26, that is to say the chisel holder 10, and the base part 44. Since both the chisel holder 10 and also the base part 44 are generally provided as forged parts, and consequently the surfaces at which mutual support takes place must be machined or reworked in a material-removing process in order to obtain the required precision, said working step can be restricted to the surface regions actually provided for this purpose, specifically the locations where the supporting surface regions 88, 90 are formed.

The counterpart supporting region 86 is formed on the base part 44 correspondingly to the supporting region 78 on the fastening shank 26. The counterpart supporting region 86 has counterpart supporting surface regions 96, 98 assigned to the supporting surface regions 88, 90. Said counterpart supporting surface regions adjoin one another in a sixth transition region 100, wherein the sixth transition region 100 is of projection-like form, preferably with a projection 102 which is elongate and convexly curved in the direction of the fastening shank receiving opening longitudinal axis $L_A$. Said projection may, for manufacturing reasons, be provided by an insert part 104 which is inserted into a corresponding opening 106 of the base part for example with an interference fit and which, in order to provide the projection 102, protrudes with a circumferential region thereof radially inward beyond the two counterpart supporting surface regions 96, 98.

The counterpart supporting surface regions 96, 98 are formed in the fastening shank receiving opening 46 in such a way that they protrude at least in regions radially inward in relation to the fastening shank receiving opening longitudinal axis $L_A$ beyond a main inner circumferential surface 108 of the fastening shank receiving opening 46. Here, the design may be such that said radial projection is at a maximum proximate to the sixth transition region 100 and decreases in the circumferential direction in the direction away from the sixth transition region 100, such that the counterpart supporting surfaces 96, 98 merge gradually into the main inner circumferential surface 108. As is the case in the embodiment of the fastening shank 100 or of the supporting region 78, it is also the case here that the surface regions to be machined in order to provide precise abutting contact are limited to the counterpart supporting surface regions 96, 98, which, in particular in their two axial end regions, may merge again in a stepped or curved manner into the main inner circumferential surface 108 on the base part 44.

Correspondingly to the inclination of the two supporting surface regions 88, 90 relative to one another attained as a result of the curved profile, the two counterpart supporting surface regions 96, 98 are also inclined relative to one another, that is to say are formed here with a curved profile, wherein said curvature may correspond to the curvature of the two supporting surface regions 88, 90 in order to attain abutting contact over a large area. Since the supporting surface regions 88, 90 and also the counterpart supporting surface regions 96, 98 protrude beyond the main outer circumferential surface 94 or the main inner circumferential surface 108 in each case only in one circumferential region, the fastening shank 26 can basically be inserted with lateral movement play into the fastening shank receiving opening 46, wherein firm abutting contact between the supporting surface regions 88, 90 and the counterpart supporting surface regions 96, 98 is generated only as a result of the movement of the fastening element 82 toward the fastening element loading surface 80. Here, contact of the two transition regions 92, 100, which leads to more intense contact pressure, is avoided. The functionality of said transition regions is substantially that of attaining a defined orientation of the chisel holder 10 relative to the base part 44 already during the insertion movement of the chisel holder 10 into the base part 44, even before the centering action of the supporting side 20 and the counterpart supporting side 48 comes into effect.

The highly uniform force distribution during the support of the fastening shank 26 on the counterpart supporting region 94 is also contributed to in that both the supporting region 78 and also the counterpart supporting region 86 are formed so as to be symmetrical, in particular point-symmetrical, with respect to the holder central plane or to a plane of symmetry, corresponding to said plane, of the base part 44.

It is pointed out that a solution which is constructed in accordance with the principles of the present invention and which can be realized in a structurally very simple manner with regard to the supporting region 78 and the counterpart supporting region 86 may also be constructed such that the supporting region 78 is basically provided on the outer circumferential surface of the fastening shank 26 without protruding beyond the main outer circumferential surface 94 thereof, that is to say for example the main outer circumferential surface 94, which is provided with an approximately circular circumferential contour, also provides the supporting surface regions 88, 90 at both sides of the transition region 92 which is of depression-like form. In this embodiment, but basically also in the embodiment with supporting surface regions 88, 90 which protrude radially in relation to the main outer circumferential surface 94, said depression-like transition region 92 may be formed as a for example substantially planar transition surface between the supporting surface regions at both sides thereof in the circumferential direction, that is to say a surface which is recessed in the radially inward direction in relation to a circumferential contour defined by the outer circumference of the fastening shank 26. A substantially planar form, attained for example by means of material-removing machining or else in a casting process, is particularly advantageous owing to its simple producibility. It would however basically also be possible for there to be provided in the transition region 92 a curved transition surface flattened slightly in relation to the curvature of the fastening shank 26. A corresponding geometry may then self-evidently also be provided on the counterpart supporting region 86 in the base part 44. There, too, the counterpart supporting surface regions 96, 98 may be integrated into the main inner circumferential surface 108, that is to say need not necessarily protrude radially inward relative thereto. In coordination with the embodiment of the transition region 92 between the supporting surface regions 88, 90 of the supporting region 78, the transition region 100 between the two counterpart supporting surface regions 96, 98 may then also be formed as a for example substantially planar transition surface, which should then be positioned opposite the correspondingly formed transition surface of the transition region 92. In the case of such an embodiment, it is possible, similarly to the situation that can be seen in FIGS. 1 and 4, for the supporting region 78 to be provided at the axial free end region of the fastening shank 26, such that, proceeding from a substantially circular circumferential contour of the main outer circumferential surface 94, which then also provides the supporting surface regions 88, 90, a substantially planar transition region 92, which is recessed in the manner of a depression radially inward in relation to the basically provided circular circumferential contour, is then for example provided in the axially free end region of the fastening shank 26. As a result of the provision of said configuration in particular at the axially free end region of the fastening shank 26, that is to say where the fastening shank 26 is pressed more intensely against the base part 44 by the load-exerting action of the fastening element 82, the abovementioned relief of load by means of the avoidance of linear and therefore very highly loaded abutting contact between the fastening shank 26 and the base part 44 is attained.

As a result of the formation of the chisel holder and of the base part with the various supporting surface regions and counterpart supporting surface regions on the supporting side and on the counterpart supporting side and also in the supporting region and in the counterpart supporting region, a defined positioning of the chisel holder is attained while at the same time the chisel holder is relieved of load in particular in the region of the fastening shank. This is contributed to by the provision of the load distribution between a plurality of supporting surface regions and supporting surfaces and also counterpart supporting surface regions and counterpart supporting surfaces which are in a defined arrangement relative to one another and at which the chisel holder and the base part bear directly against one another. This means that, within the context of the present invention, a supporting surface region or counterpart supporting surface region is formed or machined with the respective surfaces, which serve for mutual support, such that direct metal-on-metal contact can be generated. Since both the base part and also the chisel holder are generally produced as forged parts, the surfaces which serve within the context of the present invention as supporting surface regions and counterpart supporting surface regions are therefore basically produced and/or reworked in a material-removing process. In this way, the high precision of said surfaces required for a substantial relief of load and precise positioning can be ensured, which could not be realized in such a manner with a surface machined only in a forging process.

For the assembly of the above-described system, in the case of a base part which is fixed by welding to a milling drum that can be set in rotation, the chisel holder 10 is inserted with its fastening shank 26 into the fastening shank receiving opening 46 provided in the base part 44, until the two supporting surface regions 22, 24 of the chisel holder 10 come into contact with the respectively associated counterpart supporting surface regions 52, 54 of the base part. The fastening element 82, which is for example of screw-like form, is thereupon tightened such that it moves further into the fastening element receiving opening 84 and is pressed against the fastening element loading surface 80 on the fastening shank 26. This firstly serves to realize stable abutting interaction between the supporting surface regions 22, 24 and the counterpart supporting surface regions 52, 54. Secondly, stable abutment of the supporting region 78 or of the two supporting surface regions 88, 90 thereof against the counterpart supporting region 86 or the two counterpart supporting surface regions 96, 98 is achieved.

Since, during the operation of a milling machine, not only the chisels held in the chisel holder 10 become worn but rather wear can also occur in the region of the chisel holders 10 themselves, it is possible by reversing the above-described process, that is to say by removing the fastening element 82 from the fastening shank 26 and pulling the chisel holder 10 or the fastening shank 26 thereof out of the base part 44, for a worn chisel holder 10 to be removed and replaced with a new chisel holder or a less worn chisel holder. Said chisel holder is inserted with its fastening shank 26 into the associated fastening shank receiving opening 46 in the base part 44, and fixed by means of the fastening element 82, in the manner described above. In the case of repeatedly occurring wear, said process may then self-evidently be performed multiple times in conjunction with the same base part fixed to a milling drum. If wear also occurs in the region of a base part, then said base part may self-evidently also be removed from a milling drum, by severing the welded connection which holds it, and replaced with a new base part.

The invention claimed is:

1. A chisel holder, comprising:

a body region having a chisel-receiving opening which is open at least toward a chisel insertion side of the body region; and a fastening shank which extends from a supporting side of the body region and which has a shank longitudinal axis ($L_B$) and a main outer circumferential surface;

wherein on the fastening shank there are provided, on a first side, a fastening element loading region and, on a second side situated opposite in relation to the shank longitudinal axis ($L_B$), a supporting region with supporting surface regions which are inclined relative to one another and adjoin one another in a transition region extending in the direction of the shank longitudinal axis ($L_B$), wherein the fastening shank is formed, in the region of its main outer circumferential surface, with a round outer circumferential contour, wherein at least one supporting surface region is formed so as to protrude at least in regions radially outward in relation to the shank longitudinal axis ($L_B$) beyond the main outer circumferential surface of the fastening shank, and wherein the transition region is formed in the manner of a depression.

2. The chisel holder as claimed in claim 1, wherein the transition region is provided at least in regions by a concave depression.

3. The chisel holder as claimed in claim 1, wherein at least one supporting surface region, in the direction from its circumferential end region remote from the transition region toward its circumferential end region proximate to the transition region, approaches the radial level of the main outer circumferential surface.

4. The chisel holder as claimed in claim 1, wherein:

at least one supporting surface region, at its circumferential end region remote from the transition region, merges in a stepped or curved manner into the main outer circumferential surface, or at least one supporting surface region, in its axial end region proximate to the body region or in its axial end region remote from the body region, merges in a stepped or curved manner into the main outer circumferential surface.

5. The chisel holder as claimed in claim 1, wherein the supporting surface regions or the transition region are formed so as to be substantially symmetrical in relation to a holder central plane.

6. The chisel holder as claimed in claim 1, wherein at least one supporting surface region is formed so as to be curved around the shank longitudinal axis ($L_B$).

7. The chisel holder as claimed in claim 6, wherein both supporting surface regions have the same radius of curvature or curvature central point.

8. The chisel holder as claimed in claim 1, wherein the round outer circumferential contour of the fastening shank is formed, in the region of its main outer circumferential surface, is a circular, oval or elliptical outer circumferential contour.

9. The chisel holder as claimed in claim 1, wherein a longitudinal central axis ($L_M$) of the chisel-receiving opening and the shank longitudinal axis ($L_B$) are inclined relative to one another at an angle of 6° to 24°.

10. The chisel holder as claimed in claim 1, wherein the fastening element loading region comprises a fastening element loading surface, and the shank longitudinal axis ($L_B$) and a surface normal ($F_N$) of the fastening element loading surface are inclined relative to one another at an angle of 50° to 65°.

11. A chisel holder system, comprising:

a chisel holder according to claim 1; and a base part having a fastening shank receiving opening, which is open at least toward a counterpart supporting side, and a fastening element receiving opening, which is open toward the fastening shank receiving opening, wherein a fastening element which can be moved in order to exert load on the fastening element loading region is received in the fastening element receiving opening, wherein, the fastening shank receiving opening comprises a counterpart supporting region with counterpart supporting surface regions which adjoin one another in a further transition region which extends in the direction of a fastening shank receiving opening longitudinal axis ($L_A$).

12. The chisel holder system as claimed in claim 11, wherein the further transition region is formed in the manner of a projection.

13. The chisel holder system as claimed in claim 11, wherein the further transition region is formed at least in regions by a convex projection.

14. The chisel holder system as claimed in claim 11, wherein the further transition region is of complementary design to the transition region.

15. The chisel holder system as claimed in claim 11, wherein at least one counterpart supporting surface region is formed so as to protrude at least in regions radially inward in relation to the fastening shank receiving opening longitudinal axis ($L_A$) beyond a main inner circumferential surface of the fastening shank receiving opening.

16. The chisel holder system as claimed in claim 15, wherein at least one counterpart supporting surface region protrudes, at least in its circumferential end region proximate to the further transition region, beyond the main inner circumferential surface, and, in the direction of its circumferential end region remote from the further transition region, approaches the radial level of the main inner circumferential surface.

17. The chisel holder system as claimed in claim 15, wherein at least one counterpart supporting surface region, at least in its axial end region proximate to the counterpart supporting side or in its axial end region remote from the counterpart supporting side, merges in a stepped or curved manner into the main inner circumferential surface.

18. The chisel holder system as claimed in claim 11, wherein the fastening shank receiving opening is formed with a circular inner circumferential contour in the region of its main inner circumferential surface or in the region of its counterpart supporting surface regions.

19. The chisel holder system as claimed in claim 11, wherein the fastening shank receiving opening longitudinal axis ($L_A$) and a fastening element receiving opening longitudinal axis ($L_O$) are inclined relative to one another at an angle of 50° to 65°.

* * * * *